US007992542B2

(12) United States Patent
Glugla et al.

(10) Patent No.: US 7,992,542 B2
(45) Date of Patent: Aug. 9, 2011

(54) MULTIPLE SPARK PLUG PER CYLINDER ENGINE WITH INDIVIDUAL PLUG CONTROL

(75) Inventors: Chris Paul Glugla, Macomb, MI (US); Kenneth J. Rode, Riverview, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 820 days.

(21) Appl. No.: 12/045,736

(22) Filed: Mar. 11, 2008

(65) Prior Publication Data

US 2009/0229569 A1 Sep. 17, 2009

(51) Int. Cl.
*F02P 5/00* (2006.01)

(52) U.S. Cl. ..... 123/406.2; 123/636

(58) Field of Classification Search ..... 123/406.2, 123/406.11, 406.12, 621, 622, 634, 636, 123/638

See application file for complete search history.

(56) References Cited

U.S. PATENT DOCUMENTS

| | | | | |
|---|---|---|---|---|
| 4,462,380 | A | 7/1984 | Asik | |
| 5,425,339 | A | 6/1995 | Fukui | |
| 5,692,484 | A * | 12/1997 | Downey | 123/643 |
| 5,954,024 | A | 9/1999 | Duhr et al. | |
| 6,054,859 | A | 4/2000 | Takahashi et al. | |
| 6,211,680 | B1 | 4/2001 | Hohner et al. | |
| 6,246,952 | B1 | 6/2001 | Honda | |
| 6,520,149 | B2 | 2/2003 | Kokubo et al. | |
| 6,536,406 | B2 | 3/2003 | Matsubara et al. | |
| 6,748,922 | B2 | 6/2004 | Uchida et al. | |
| 6,843,225 | B1 * | 1/2005 | Ise | 123/406.56 |
| 6,860,256 | B2 | 3/2005 | Nakamura et al. | |
| 6,883,509 | B2 | 4/2005 | Porter et al. | |
| 6,886,547 | B2 | 5/2005 | Butler, Jr. | |
| 6,910,449 | B2 | 6/2005 | Strom et al. | |
| 6,922,628 | B2 | 7/2005 | Zhu et al. | |
| 6,945,229 | B1 | 9/2005 | Zhu et al. | |
| 6,951,201 | B2 | 10/2005 | Zhu et al. | |

(Continued)

FOREIGN PATENT DOCUMENTS

GB 2396754 A 6/2004

OTHER PUBLICATIONS

Schneider, et al., An Investigation of the Impact of Cycle-to-cycle Variations on the Ionic Current Signal in SI Engines, SAE 2000-01-1943, Jun. 19-22, 2000.

(Continued)

*Primary Examiner* — Hieu T Vo

(74) *Attorney, Agent, or Firm* — Julia Voutyras; Brooks Kushman P.C.

(57) ABSTRACT

A system and method for operating a multiple cylinder internal combustion engine having at least two spark plugs per cylinder include a first control wire coupled to a first spark plug of a first cylinder and a second spark plug of a second cylinder, and a second control wire coupled to a second spark plug of the first cylinder and a first spark plug of the second cylinder with the first and second spark plugs of the first cylinder being selectively fired during the power stroke of the first cylinder and the first and second spark plugs of the second cylinder being selectively fired during the power stroke of the second cylinder to provide individual control of each spark plug using a number of control lines less than the number of spark plugs.

20 Claims, 4 Drawing Sheets

U.S. PATENT DOCUMENTS

| | | | | |
|---|---|---|---|---|
| 7,005,855 | B2 | 2/2006 | Zhu et al. | |
| 7,059,296 | B2 | 6/2006 | Strom et al. | |
| 7,086,382 | B2 | 8/2006 | Daniels et al. | |
| 7,156,070 | B2 | 1/2007 | Strom et al. | |
| 7,251,557 | B2 | 7/2007 | Strom et al. | |
| 7,255,080 | B1 | 8/2007 | Leone | |
| 7,268,655 | B2 | 9/2007 | Skinner et al. | |
| 7,404,396 | B2 * | 7/2008 | Toriyama et al. | 123/637 |
| 2004/0083717 | A1 | 5/2004 | Zhu et al. | |
| 2004/0083794 | A1 | 5/2004 | Zhu et al. | |
| 2004/0084018 | A1 | 5/2004 | Zhu et al. | |
| 2004/0084019 | A1 | 5/2004 | Zhu et al. | |
| 2004/0084025 | A1 | 5/2004 | Zhu et al. | |
| 2004/0084026 | A1 | 5/2004 | Zhu et al. | |
| 2004/0084034 | A1 | 5/2004 | Huberts et al. | |
| 2004/0084035 | A1 | 5/2004 | Newton | |
| 2004/0085068 | A1 | 5/2004 | Zhu et al. | |
| 2004/0085069 | A1 | 5/2004 | Zhu et al. | |
| 2004/0085070 | A1 | 5/2004 | Daniels et al. | |
| 2004/0088102 | A1 | 5/2004 | Daniels et al. | |
| 2005/0028786 | A1 | 2/2005 | Zhu et al. | |
| 2005/0050948 | A1 | 3/2005 | Zhu et al. | |
| 2005/0055169 | A1 | 3/2005 | Zhu et al. | |
| 2005/0090966 | A1 | 4/2005 | Strom et al. | |
| 2005/0126537 | A1 | 6/2005 | Daniels et al. | |
| 2005/0211219 | A1 | 9/2005 | Strom et al. | |
| 2005/0247064 | A1 | 11/2005 | Lieuwen | |
| 2006/0042355 | A1 | 3/2006 | Zhu et al. | |
| 2006/0091987 | A1 | 5/2006 | Skinner et al. | |
| 2006/0241848 | A1 | 10/2006 | Strom et al. | |
| 2007/0095326 | A1 | 5/2007 | Strom et al. | |
| 2007/0215101 | A1 | 9/2007 | Russell et al. | |
| 2007/0215102 | A1 | 9/2007 | Russell et al. | |
| 2007/0215104 | A1 | 9/2007 | Hahn | |
| 2007/0215107 | A1 | 9/2007 | Shelby et al. | |
| 2007/0215111 | A1 | 9/2007 | Surnilla | |
| 2007/0215130 | A1 | 9/2007 | Shelby et al. | |

OTHER PUBLICATIONS

Yutaka Ohashi et al., The Application of Ionic Current Detection System for the Combustion Condition Control, SAE 1999-01-0550, Mar. 1-4, 1999.

Schneider et al., Real-Time Air/Fuel-Ration Control in a Small SI Engine Using the Ionic Current Signal, SAE 1999-01-3323, JSAE 9938078, Sep. 28-30, 1999.

Wilstermann et al., Ignition System Integrated AC Ion Current Sensing for Robust and Reliable Online Engine Control, SAE 2000-01-0553, Mar. 6-9, 2000.

Schneider et al., An Investigation of the Impact of Cycle-to-Cycle Variations on the Ionic Current Signal in SI Engines, SAE 2000-01-1943, Jun. 19-22, 2000.

Toon de Bie, et al. A Novel Start Algorithm for CNG Engines Using Ion Sense Technology, SAE 2000-01-2800, Oct. 16-19, 2000.

Noriaki Kondo, et al., Combustion Monitoring by use of the Spark Plug for DI Engine, SAE 2001-01-0994, Mar. 5-8, 2001.

Yoshiyama, et al., Combustion Diagnostics of a Spark Ignition Engine Using a Spark Plug as an Ion Probe, SAE 2002-01-2838, Oct. 21-24, 2002.

Malaczynski, et al., Real-Time Digital Signal Processing of Ionization Current for Engine Diagnostic and Control, SAE 2003-01-1119, Mar. 3-6, 2003.

Strandh, et al., Ion Current Sensing for HCCI Combustion Feedback, SAE 2003-01-3216, 2003.

Huang, et al., Effects of Engine Operating Conditions on In-Cylinder Air/Fuel Ratio Detection Using a Production Ion Sensing Device, SAE 2004-01-0515, Mar. 8-11, 2004.

Vressner, et al., Multiple Point Ion Current Diagnostics in an HCCI Engine, SAE 2004-01-0934, Mar. 8-11, 2004.

Shimasaki, et al., Study on Combustion Monitoring System for Formula One Engines Using Ionic Current Measurement, SAE 2004-01-1921, Jun. 8-10, 2004.

Huang, Yiqun, et al., Investigation of an In-cylinder Ion Sensing Assisted HCCI Control Strategy, SAE2005-01-0068, Apr. 11-14, 2005.

Vressner, et al., Fuel Effects on Ion Current in an HCCI Engine, SAE 2005-01-2093, 2005.

Yoshiyama, et al., Ion Current During the Exhaust Process Under the Idling Condition in a Spark Ignition Engine, SAE 2005-01-3872, Oct. 24-27, 2005.

Rado, et al., Significance of Burn Types, as Measured by Using the Spark Plugs as Ionization Probes, with Respect to the Hydrocarbon Emission Levels in S.I. Engines, SAE 750354, Feb. 24-28, 1975.

Saltzkoff, et al., An Ionization Equilibrium Analysis of the Spark Plug as an Ionization Sensor, SAE960337, Feb. 26-29, 1996.

Fei An, et al., Combustion Diagnostics in Methane-Fueled SI Engines Using the Spark Plug as an Ionization Probe, SAE970033, Feb. 24-27, 1997.

Eriksson, et al., Closed Loop Ignition Control by Ionization Current Interpretation, SAE 970854, Feb. 24-27, 1997.

Reinmann, et al., Local Air-Fuel Ratio Measurements Using the Spark Plug as an Ionization Sensor, SAE 970856, Feb. 24-27, 1997.

Saltzkoff, et al., In-Cylinder Pressure Measurements Using the Spark Plug as an Ionization Sensor, SAE 970857, Feb. 24-27, 1997.

Asano, et al., Development of New Ion Current Combustion Control System, SAE 980162, Feb. 23-26, 1998.

Balles, et al., In-Cylinder Air/Fuel Ratio Approximation Using Spark Gap Ionization Sensing, SAE 980166, Feb. 23-26, 1998.

Ohashi, et al., The Application of Ionic Current Detection System for the Combustion Limit Control, SAE 980171, Feb. 23-26, 1998.

* cited by examiner

MULTIPLE SPARK PLUG PER CYLINDER ENGINE WITH INDIVIDUAL PLUG CONTROL

BACKGROUND

1. Technical Field

The present disclosure relates to systems and methods for controlling an internal combustion engine having two or more spark plugs per cylinder and individual plug control.

2. Background Art

Spark-ignited internal combustion engines may be configured with ignition systems that feature two or more spark plugs for each cylinder to accommodate flexible fuel applications or to provide more ignition energy for leaner air/fuel ratios to improve combustion and enhance fuel economy, for example. Multiple spark plugs may be powered from a common ignition coil and fire at the same time, similar to distributorless ignition systems (DIS) where power paired spark plugs (associated with different cylinders) are fired at the same time with one cylinder in the power stroke and one in the exhaust stroke (waste spark) to improve cost effectiveness of these applications. However, multi-plug applications powered by a common ignition coil present various challenges for implementing ion sensing technology and providing individual spark plug control in a cost-effective manner.

Other solutions for controlling multiple spark plug per cylinder engines include connecting one of the spark plugs to the engine controller and connecting the second spark plug for the same cylinder to the first spark plug using an electric or electronic circuit to provide a delay between firing the first spark plug in response to the command from the controller and the second spark plug in response to the delayed signal through the electronic circuit. Alternatively, each spark plug may have a dedicated control wire from the engine controller to provide increased control flexibility. However, this requires additional controller outputs and associated drivers, which increases complexity and cost.

SUMMARY

A system and method for operating a multiple cylinder internal combustion engine having at least two spark plugs per cylinder include a first control wire coupled to a first spark plug of a first cylinder and a second spark plug of a second cylinder, and a second control wire coupled to a second spark plug of the first cylinder and a first spark plug of the second cylinder with the first and second spark plugs of the first cylinder being selectively fired during the power stroke of the first cylinder and the first and second spark plugs of the second cylinder being selectively fired during the power stroke of the second cylinder to provide individual control of each spark plug using a number of control lines less than the number of spark plugs.

In one embodiment, a multiple cylinder internal combustion engine includes first and second spark plugs per cylinder with the first spark plug of a first cylinder connected to a first secondary winding of a first ignition coil and the second spark plug of the first cylinder connected to a first secondary winding of a second ignition coil with the second secondary winding of the first ignition coil connected to a first spark plug of a second cylinder and the second secondary winding of the second ignition coil connected to the second spark plug of the second cylinder. Embodiments may include an ion sensing circuit connected to at least one of the first and second secondary windings of one or more cylinders.

One embodiment of a method for controlling an internal combustion engine having at least two spark plugs per cylinder each connected to an engine controller by a corresponding control line with each control line connected to at least one spark plug in each of at least two cylinders includes generating first and second spark signals on corresponding first and second control lines associated with first and second spark plugs of a first cylinder during the power stroke of the first cylinder, while substantially simultaneously applying the first and second signals to first and second spark plugs associated with a second cylinder.

The present disclosure includes embodiments having various advantages. For example, the systems and methods of the present disclosure can provide individual control of each spark plug associated with a common cylinder to more accurately control the combustion process while using only a total number of control lines corresponding to the number of cylinders to reduce cost and complexity of the control system. Individual spark plug control in a multiple spark plug per cylinder application facilitates selective simultaneous or offset firing of spark plugs associated with a common cylinder during the same phase of the combustion cycle. Every spark plug is under programmable control of the engine controller while using only a total of one control line or wire (and controller output) per cylinder to reduce controller and driver cost as well as overall system complexity.

The above advantages and other advantages and features will be readily apparent from the following detailed description of the preferred embodiments when taken in connection with the accompanying drawings.

DETAILED DESCRIPTION OF THE DRAWINGS

Figure 3:
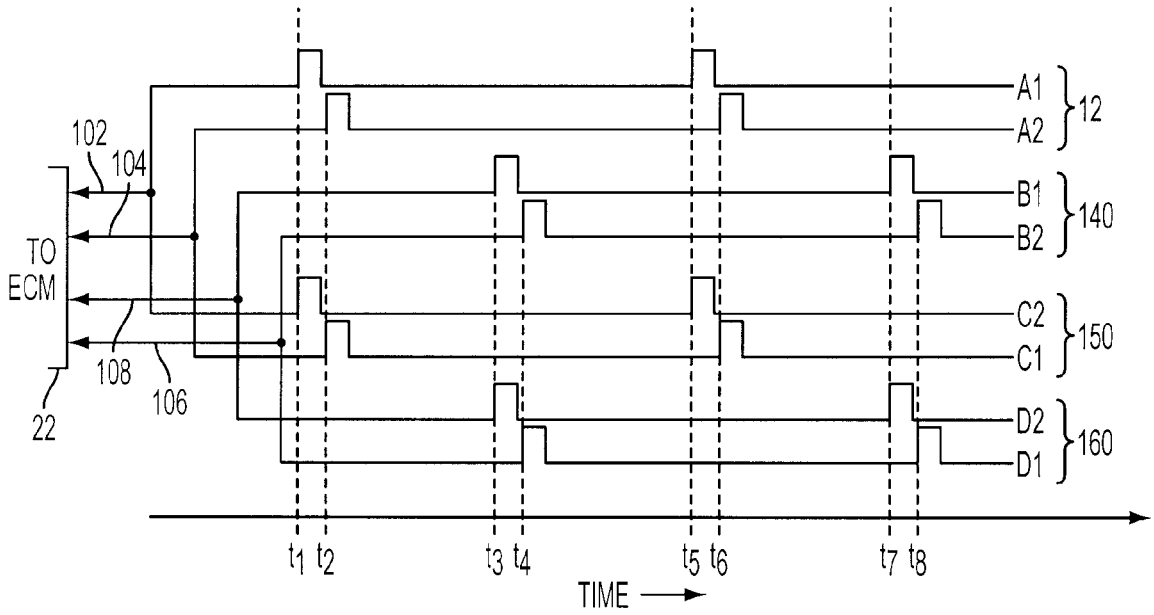
Figure 4:
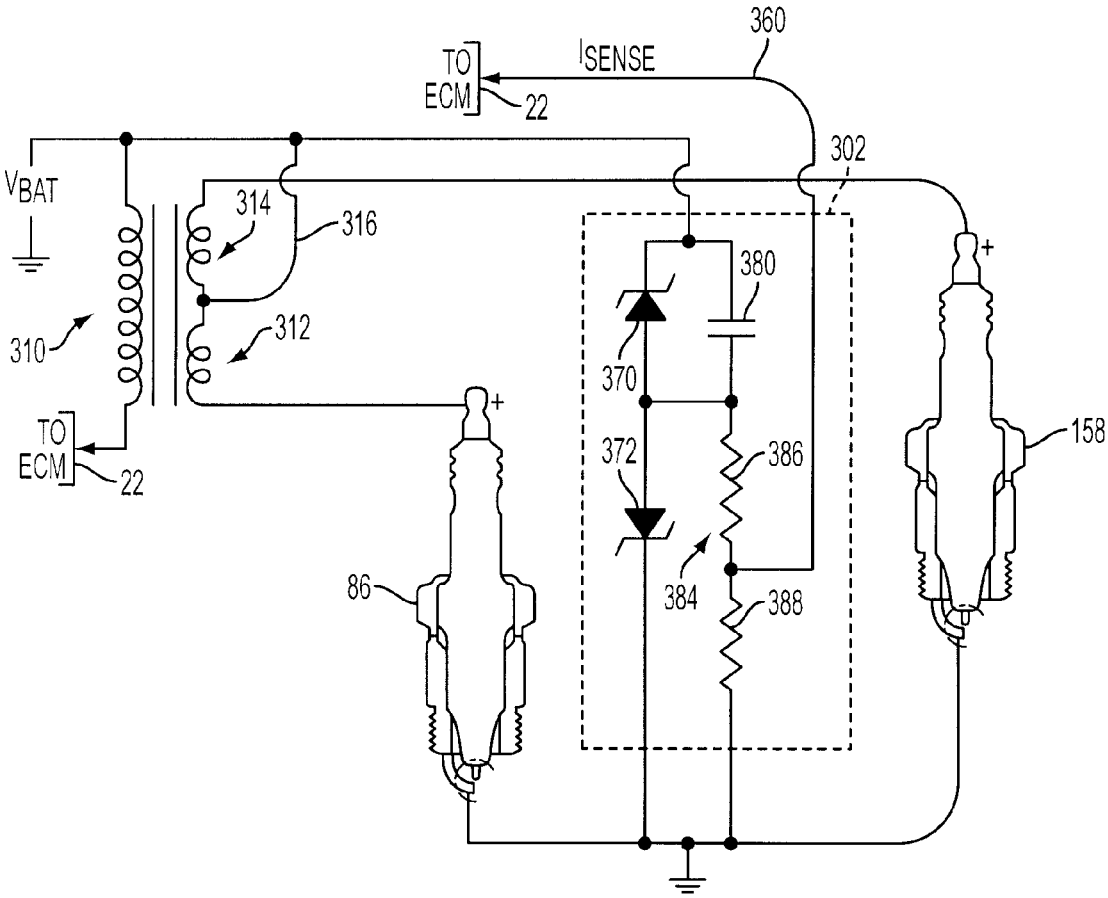

FIG. 3 is a timing diagram illustrating operation of a system or method for providing individual control of multiple spark plugs per cylinder according to embodiments of the present disclosure; and FIG. 4 is a simplified schematic illustrating an optional ion sense circuit for a multiple spark plug per cylinder application with individual spark plug control according to one embodiment of the present disclosure.

DETAILED DESCRIPTION OF EMBODIMENT(S)

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. The representative embodiments used in the illustrations relate generally to a multi-cylinder, internal combustion engine with direct or in-cylinder injection with an optional ion sensing system that uses a spark plug, glow plug, or dedicated ionization sensor disposed within the cylinders. Those of ordinary skill in the art may recognize similar applications or implementations with other engine/vehicle technologies.

System 10 includes an internal combustion engine having a plurality of cylinders, represented by cylinder 12, with corresponding combustion chambers 14. As one of ordinary skill in the art will appreciate, system 10 includes various sensors and actuators to effect control of the engine. A single sensor or actuator may be provided for the engine, or one or more sensors or actuators may be provided for each cylinder 12, with a representative actuator or sensor illustrated and described. For example, each cylinder 12 may include four actuators that operate intake valves 16 and exhaust valves 18 for each cylinder in a multiple cylinder engine. However, the engine may include only a single engine coolant temperature sensor 20.

Controller 22, sometimes referred to as an engine control module (ECM), powertrain control module (PCM) or vehicle control module (VCM), has a microprocessor 24, which is part of a central processing unit (CPU), in communication with memory management unit (MMU) 25. MMU 25 controls the movement of data among various computer readable storage media and communicates data to and from CPU 24. The computer readable storage media preferably include volatile and nonvolatile storage in read-only memory (ROM) 26, random-access memory (RAM) 28, and keep-alive memory (KAM) 30, for example. KAM 30 may be used to store various operating variables while CPU 24 is powered down. The computer-readable storage media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by CPU 24 in controlling the engine or vehicle into which the engine is mounted. The computer-readable storage media may also include floppy disks, CD-ROMS, hard disks, and the like.

In one embodiment, the computer readable storage media include stored data representing instructions executable by controller 22 to control a multiple cylinder internal combustion engine having at least two spark plugs per cylinder. The data represent instructions for generating a first command signal on a first control wire to discharge a first spark plug associated with a first cylinder of the engine during a power stroke of the first cylinder and instructions for generating a second command signal on a second control wire to discharge a second spark plug associated with the first cylinder of the engine during the same power stroke of the first cylinder. The instructions may include a programmable time dependent or event-driven delay interval between generating the first command signal and generating the second command signal. Instructions may also include instructions for applying a bias voltage across at least one of the first and second spark plugs of the first cylinder to generate an ion sense current after generating the first and second command signals.

System 10 includes an electrical system powered at least in part by a battery 116 providing a nominal voltage, $V_{BAT}$, which is typically either 12V or 24V, to power controller 22. As will be appreciated by those of ordinary skill in the art, the nominal voltage is an average design voltage with the actual steady-state and transient voltage provided by the battery varying in response to various ambient and operating conditions that may include the age, temperature, state of charge, and load on the battery, for example. Power for various engine/vehicle accessories may be supplemented by an alternator/generator during engine operation as well known in the art. A high-voltage power supply 120 may be provided in applications using direct injection and/or to provide the bias voltage for ion current sensing. Alternatively, ion sensing circuitry may be used to generate the bias voltage using the ignition coil and/or a capacitive discharge circuit as described in greater detail with reference to FIG. 4.

Figure 1:
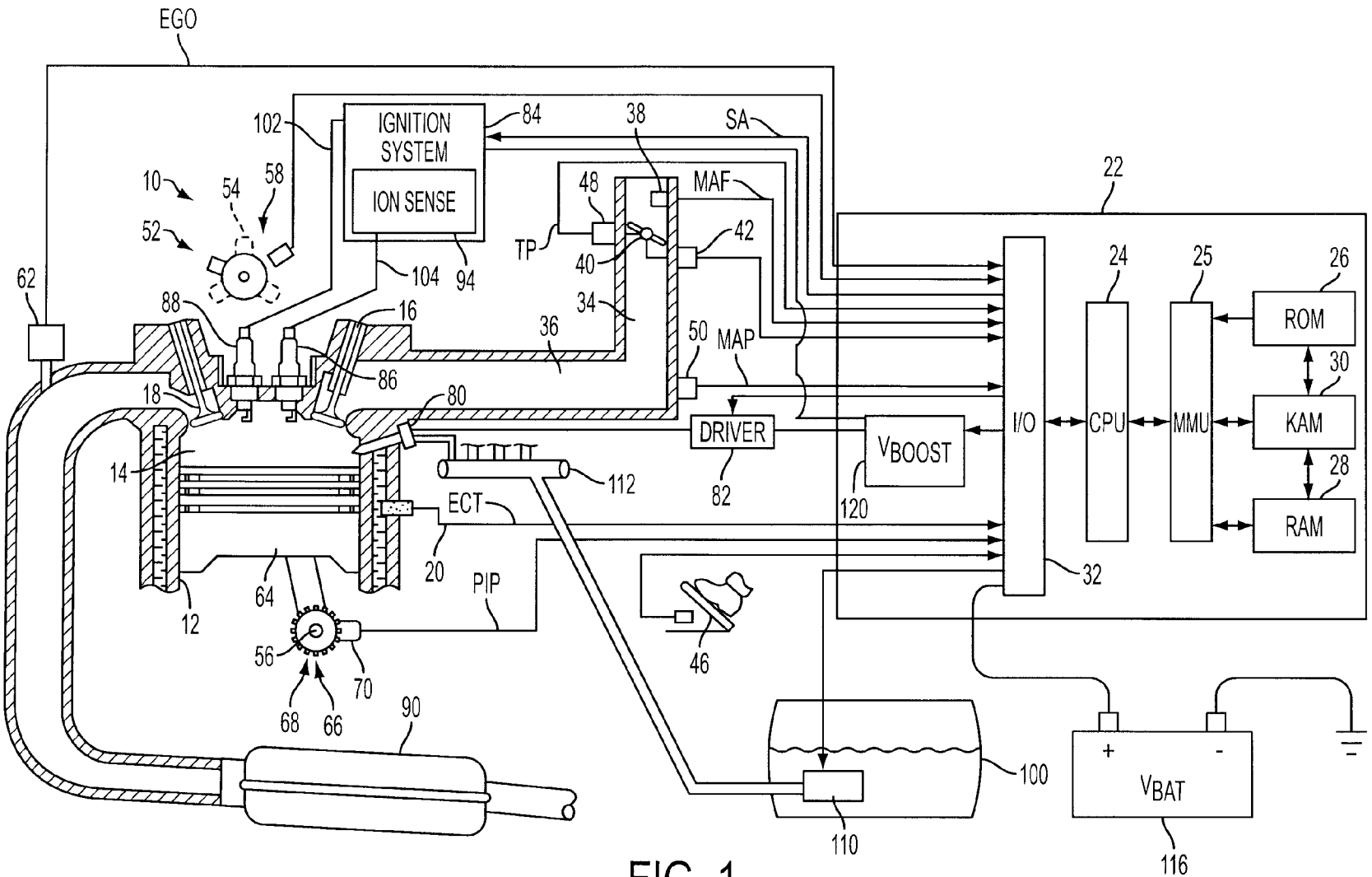
FIG. 1 is a block diagram illustrating operation of a system or method for controlling a multiple-plug-per-cylinder internal combustion engine having a common ignition coil according to one embodiment of the present disclosure.

In applications having a separate high-voltage power supply, power supply 120 generates a boosted nominal voltage, $V_{BOOST}$, relative to the nominal battery voltage and may be in the range of 85V-100V, for example, depending upon the particular application and implementation. Power supply 120 may be used to power fuel injectors 80 and one or more ionization sensors, which may be implemented by spark plugs 86, 88. As illustrated in the embodiment of FIG. 1, the high-voltage power supply 120 may be integrated with control module 22. Alternatively, an external high-voltage power supply may be provided if desired. Although illustrated as a single functional block in FIG. 1, some applications may have multiple internal or external high-voltage power supplies 120 that each service components associated with one or more cylinders or cylinder banks, for example.

CPU 24 communicates with various sensors and actuators via an input/output (I/O) interface 32. Interface 32 may be implemented as a single integrated interface that provides various raw data or signal conditioning, processing, and/or conversion, short-circuit protection, and the like. Alternatively, one or more dedicated hardware or firmware chips may be used to condition and process particular signals before being supplied to CPU 24. Examples of items that are actuated under control by CPU 24, through I/O interface 32, are fuel injection timing, fuel injection rate, fuel injection duration, throttle valve position, spark plug ignition timing ionization current sensing and conditioning, and others. Sensors communicating input through I/O interface 32 may indicate piston position, engine rotational speed, vehicle speed, coolant temperature, intake manifold pressure, accelerator pedal position, throttle valve position, air temperature, exhaust temperature, exhaust air to fuel ratio, exhaust constituent concentration, and air flow, for example. Some controller architectures do not contain an MMU 25. If no MMU 25 is employed, CPU 24 manages data and connects directly to ROM 26, RAM 28, and KAM 30. Of course, more than one CPU 24 may be used to provide engine control and controller 22 may contain multiple ROM 26, RAM 28, and KAM 30 coupled to MMU 25 or CPU 24 depending upon the particular application.

In operation, air passes through intake 34 and is distributed to the plurality of cylinders via an intake manifold, indicated generally by reference numeral 36. System 10 preferably includes a mass airflow sensor 38 that provides a corresponding signal (MAF) to controller 22 indicative of the mass airflow. A throttle valve 40 may be used to modulate the airflow through intake 34. Throttle valve 40 is preferably electronically controlled by an appropriate actuator 42 based on a corresponding throttle position signal generated by controller 22. The throttle position signal may be generated in response to a corresponding engine output or demanded torque indicated by an operator via accelerator pedal 46. A throttle position sensor 48 provides a feedback signal (TP) to controller 22 indicative of the actual position of throttle valve 40 to implement closed loop control of throttle valve 40.

A manifold absolute pressure sensor 50 is used to provide a signal (MAP) indicative of the manifold pressure to controller 22. Air passing through intake manifold 36 enters combustion chamber 14 through appropriate control of one or more intake valves 16. Intake valves 16 and exhaust valves 18 may be controlled using a conventional camshaft arrangement, indicated generally by reference numeral 52. Camshaft arrangement 52 includes a camshaft 54 that completes one revolution per combustion or engine cycle, which requires two revolutions of crankshaft 56 for a four-stroke engine, such that camshaft 54 rotates at half the speed of crankshaft 56. Rotation of camshaft 54 (or controller 22 in a variable cam timing or camless engine application) controls one or more exhaust valves 18 to exhaust the combusted air/fuel mixture through an exhaust manifold. A sensor 58 provides a signal from which the rotational position of the camshaft can be determined. Cylinder identification sensor 58 may include a single-tooth or multi-tooth sensor wheel that rotates with camshaft 54 and whose rotation is detected by a Hall effect or variable reluctance sensor. Cylinder identification sensor 58 may be used to identify with certainty the position of a designated piston 64 within cylinder 12 for use in determining fueling, ignition timing, or ion sensing for example.

Additional rotational position information for controlling the engine is provided by a crankshaft position sensor 66 that includes a toothed wheel 68 and an associated sensor 70.

An exhaust gas oxygen sensor 62 provides a signal (EGO) to controller 22 indicative of whether the exhaust gasses are lean or rich of stoichiometry. Depending upon the particular application, sensor 62 may by implemented by a HEGO sensor or similar device that provides a two-state signal corresponding to a rich or lean condition. Alternatively, sensor 62 may be implemented by a UEGO sensor or other device that provides a signal proportional to the stoichiometry of the exhaust feedgas. This signal may be used to adjust the air/fuel ratio, or control the operating mode of one or more cylinders, for example. The exhaust feedgas is passed through the exhaust manifold and one or more emission control or treatment devices 90 before being exhausted to atmosphere.

A fuel delivery system includes a fuel tank 100 with a fuel pump 110 for supplying fuel to a common fuel rail 112 that supplies injectors 80 with pressurized fuel. In some direct-injection applications, a camshaft-driven high-pressure fuel pump (not shown) may be used in combination with a low-pressure fuel pump 110 to provide a desired fuel pressure within fuel rail 112. Fuel pressure may be controlled within a predetermined operating range by a corresponding signal from controller 22. In the representative embodiment illustrated in FIG. 1, fuel injector 80 is side-mounted on the intake side of combustion chamber 14, typically between intake valves 16, and injects fuel directly into combustion chamber 14 in response to a command signal from controller 22 processed by driver 82. Of course, the present disclosure may also be applied to applications having fuel injector 80 centrally mounted through the top or roof of cylinder 14, or with a port-injected configuration, for example.

Driver 82 may include various circuitry and/or electronics to selectively supply power from high-voltage power supply 120 to actuate a solenoid associated with fuel injector 80 and may be associated with an individual fuel injector 80 or multiple fuel injectors, depending on the particular application and implementation. Although illustrated and described with respect to a direct-injection application where fuel injectors often require high-voltage actuation, those of ordinary skill in the art will recognize that the teachings of the present disclosure may also be applied to applications that use port injection or combination strategies with multiple injectors per cylinder and/or multiple fuel injections per cycle.

In the embodiment of FIG. 1, fuel injector 80 injects a quantity of fuel directly into combustion chamber 14 in one or more injection events for a single engine cycle based on the current operating mode in response to a signal (fpw) generated by controller 22 and processed and powered by driver 82. At the appropriate time during the combustion cycle, controller 22 generates signals (SA) processed by ignition system 84 to individually control multiple spark plugs 86, 88 associated with a single cylinder 12 during the power stroke of the cylinder to initiate combustion within chamber 14. In applications having ion sense capabilities, controller may subsequently apply a high-voltage bias across at least one spark plug 86, 88 to enable ionization current sensing as described herein. Depending upon the particular application, the high-voltage bias may be applied across the spark (air) gap or between the center electrode of spark plug 86, 88 and the wall of cylinder 12. Ignition system 84 may include one or more ignition coils with each ignition coil having a primary winding and one or more secondary windings to efficiently control multiple spark plugs and provide the same polarity signal to each spark plug of a particular cylinder 12. Charging of the ignition coil may be powered by high-voltage power supply 120 or by battery voltage depending upon the particular application and implementation.

As shown in FIG. 1, ignition system 84 may optionally include an ion sense circuit 94 associated with one or both of the spark plugs 86, 88 of a particular cylinder 12. As described in greater detail with reference to FIG. 4, ion sense circuit 94 operates to selectively apply a bias voltage to at least one of spark plugs 86, 88 after spark discharge to generate a corresponding ion sense current applied to a spark plug control wire connected to controller 22. The ion sense current may be used by controller 22 for various diagnostic and combustion control purposes. In one embodiment, the ion sense current is used as a feedback signal to provide closed loop control of the delay between firing of first and second spark plugs associated with a corresponding common cylinder. The ion sense signal may be used to determine whether or not to fire the second spark plug of a cylinder, the delay or offset for firing the second spark plug after firing the first spark plug, whether to fire both spark plugs simultaneously, and/or whether to fire one or both spark plugs two or more times during the same combustion phase. Alternatively, any one or more of the spark modes may be controlled open loop without using the ion sense signal, or closed loop based on various other combustion information ascertained by measurements provided by an in-cylinder pressure transducer, optical sensor, strain gauge, knock sensor, and/or crankshaft position sensor, for example.

In one embodiment, each cylinder 12 includes a dedicated coil and associated ion sense electronics for individually controlling the firing of multiple spark plugs associated with each cylinder with a total number of control wires less than the total number of spark plugs. The coil and electronics may be physically located in a coil pack associated with one spark plug 88 of a pair or group of spark plugs associated with a particular cylinder 12, sometimes referred to as a coil-on-plug implementation, with a high-voltage conductor connecting the other spark plugs in the pair/group associated with a different cylinder or cylinders to the coil pack. Alternatively, a single ignition system 84 may be associated with multiple cylinders 12. In addition, ignition system 84 may include various components to provide selective ionization current sensing as described with reference to FIG. 4. The representative embodiment illustrated includes at least two spark plugs 86, 88 in each cylinder that are powered by corresponding ignition coils arranged with dual secondary windings or a center-tapped secondary winding configuration such that both spark plugs 86, 88 associated with a single or common cylinder may be individually controlled by controller 22 to generate a spark to ignite a fuel/air mixture within combustion chamber 14. Those of ordinary skill in the art may recognize other applications consistent with the teachings of the present disclosure where multiple dual function actuators/ion sensors are used.

Figure 2:
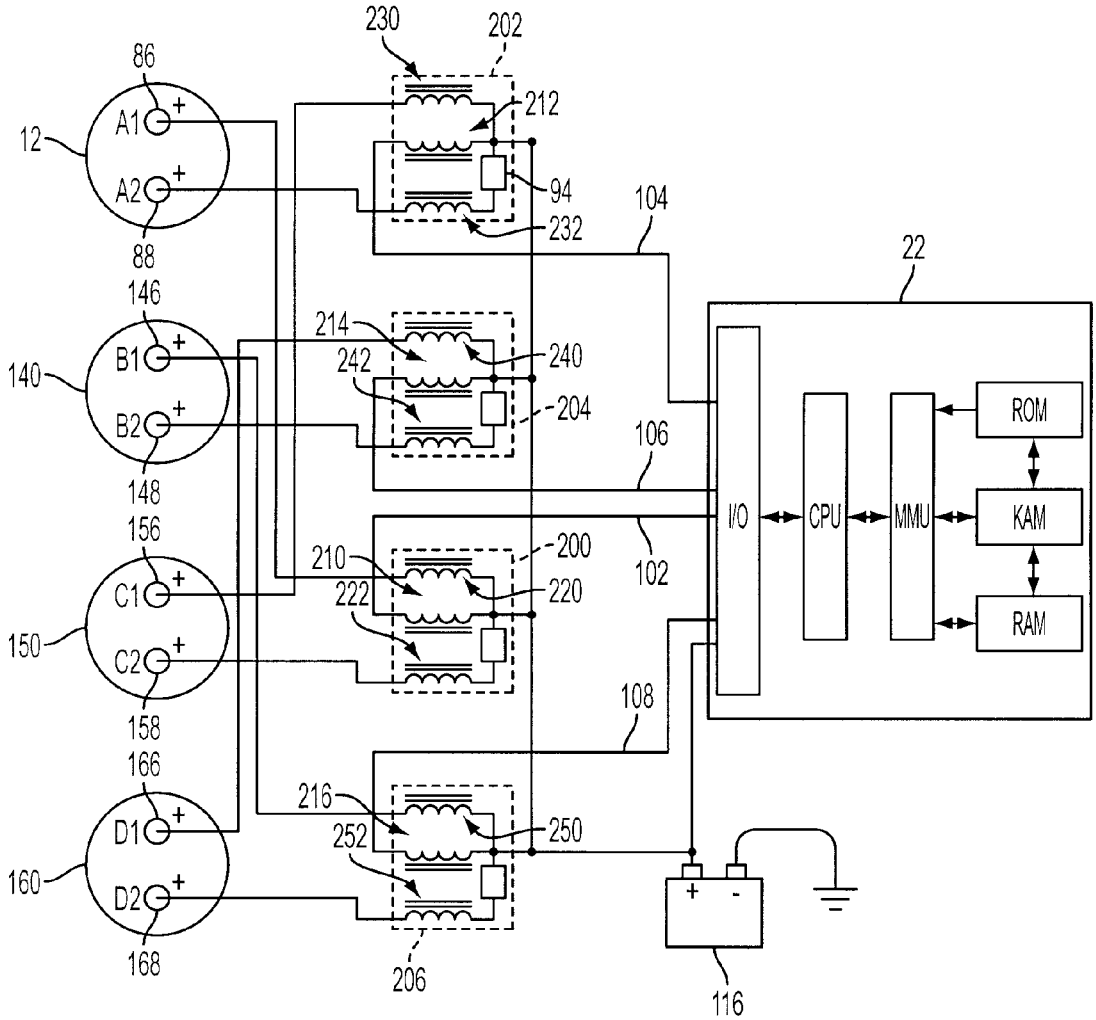
FIG. 2 illustrates a representative embodiment of a four cylinder engine having individual spark plug control of eight spark plugs using only four control lines according to the present disclosure.

Controller 22 includes software and/or hardware implementing control logic to control system 10. Controller 22 generates signals to initiate coil charging and subsequent spark discharge and may optionally monitor ionization current during an ionization current sensing period after spark discharge. The ionization current signal may be used to provide information relative to combustion quality and timing and to detect various conditions that may include engine knock, misfire, pre-ignition, etc. as known in the art. As described in greater detail with reference to FIGS. 2-4, controller 22 is coupled by a first control wire 102 to first spark plug 86 of first cylinder 12 and is coupled by a second control wire 104 to second spark plug 88 of first cylinder 12 to provide individual spark discharge control of spark plugs 86, 88 during a power stroke of cylinder 12 while controlling all spark plugs of the engine with fewer control wires than the total number of spark plugs. For example, as shown in FIGS. 2 and 3, in a four-cylinder engine having two spark plugs per cylinder, controller 22 can provide individual control of spark discharge for each of the eight spark plugs using only four outputs connected to corresponding spark plug control signal wires. In this representative embodiment, the number of spark plug signal wires is equal to the number of cylinders in the engine. This multiplexing of spark plug control is accomplished according to the present disclosure by connecting each control wire 102, 104 to at least two spark plugs 86, 146 associated with corresponding at least two different cylinders, such as cylinders 12, 140 (FIG. 2), for example.

FIG. 2 is a simplified schematic illustrating one embodiment of a multi-plug-per-cylinder internal combustion engine with individual spark plug control according to the present disclosure. Spark plugs 86, 88 are each associated with a common cylinder 12 and may be disposed symmetrically or asymmetrically within the cylinder through the top and/or side of the cylinder. Spark plugs 86 and 88 are powered by corresponding ignition coils or coil packs 200, 202, respectively, that may be physically positioned on one of the spark plugs, e.g. in a coil-on-plug application, or may be remotely located within the engine compartment. In the representative embodiment illustrated in FIG. 2, each ignition coil or coil pack 200, 202, 204, 206 includes a primary winding 210, 212, 214, 216, respectively, connected to controller 22 via corresponding spark plug control signal wires 102, 104, 106, 108. Each primary winding 210, 212, 214, 216 is electromagnetically coupled to corresponding first and second secondary windings 220, 222; 230, 232; 240, 242; and 250, 252, respectively. The first and second secondary windings may be wound in opposite directions to apply the same voltage polarity across associated spark plugs. Although the present disclosure illustrates individual spark plug control using ignition coils having dual or multiple secondary windings, similar advantages and benefits may be obtained using ignition coils having a single primary and single secondary winding. However, use of dual or multiple secondary windings may have additional benefits with respect to reducing the number of coils required and the associated cost and system complexity.

As also shown in FIG. 2, one or more ignition coils or coil packs, such as ignition coil 200, may include an ionization sensing module 94 that applies a bias voltage to one or more associated secondary windings 220, 222 and across at least one of spark plugs 86, 88 during an ionization current sensing period to generate an ionization current and associated voltage/current signal as described in greater detail herein. Alternatively, ionization sensing module 94 may be remotely located within the engine compartment and/or combined with ignition system 84 or controller 22 (FIG. 1).

In the representative embodiment illustrated in FIG. 2, primary windings 210, 212, 214, 216 are connected to and powered by a battery 116 or other power supply, such as a high-voltage power supply as described with reference to FIG. 1. Controller 22 uses control signal wires 102, 104, 106, 108 to selectively connect the opposite side of the primary windings to ground to charge the ignition coils. To initiate a spark discharge in a corresponding spark plug, controller 22 opens the primary winding circuit resulting in a rapid collapse of the magnetic field and generation of a spark discharge voltage across the associated spark plugs (of two or more cylinders) that exceeds the air gap breakdown voltage resulting in a spark discharge to initiate combustion within the cylinders as known in the art. After the spark discharge, an associated ionization sensing module 94 may apply a bias voltage to one or more secondary windings during an ionization current sensing period of the combustion cycle. The flame front and ions created during combustion of the air/fuel mixture are generally sufficient to generate a small ionization current through the spark plug(s) (on the order of microamperes) that can be processed by controller 22 to provide information about the timing and quality of combustion, inter alia.

As illustrated in FIGS. 2 and 3, cylinders 12, 140, 150, and 160 each have first and second spark plugs 86, 88; 146, 148; 156, 158; and 166, 168, respectively, with each spark plug connected to a secondary winding of one of the ignition coils 200, 202, 204, and 206 and each ignition coil connected to spark plugs associated with two different engine cylinders. For example, ignition coil 200 includes a first secondary winding 220 connected to a first spark plug 86 of a first cylinder 12 and a second secondary winding 222 connected to a second spark plug 158 of a second cylinder 150. Cylinders having spark plugs connected to a common coil, such as cylinders 12 and 150, are preferably spaced or phased with respect to the cylinder firing order such that the piston within the first cylinder 12 is in a power stoke when the piston in the second cylinder 150 is in another combustion phase or stroke, such as an exhaust stroke, for example.

As shown in the representative spark timing diagram of FIG. 3, controller 22 generates a first command signal on a first control wire 102 to discharge a first spark plug A1 of a first cylinder 12 during a power stroke of first cylinder 12. Controller generates a second command signal on a second control wire 104 to discharge a second spark plug A2 of the first cylinder during a power stroke of the first cylinder. The second command signal may be generated after a programmable delay or interval relative to the first command signal to provide offset firing of spark plugs A1 and A2 during the power stroke of cylinder 12 when a compressed air/fuel mixture is present to initiate combustion. Alternatively, the first and second signals may be generated substantially simultaneously to generate corresponding substantially simultaneous spark discharges during the power stroke of a particular cylinder.

The first signal generated by controller 22 on first control wire 102 controls primary winding 210 of ignition coil 200, which is electromagnetically coupled to first and second secondary windings 220, 222. As such, a spark discharge is also initiated across a second spark plug C2 connected to second secondary winding 222 of ignition coil 200 associated with a second cylinder 150, which is in another combustion phase, such as an exhaust stroke. Similarly, the second signal generated by controller 22 on second control wire 104 controls primary winding 212, which is electromagnetically coupled to first secondary winding 230 and second secondary winding 232. As such, a spark discharge is initiated for a second spark plug A2 of a first cylinder 12 and a first spark plug C2 of a second cylinder 150.

In a similar fashion, controller 22 generates first and second control signals on control wires 108 and 106 to individually control spark plugs 146 and 148, respectively, during a power stroke of cylinder 140. Control wires 102, 104 are then used again to individually control spark discharge of spark plugs 158, 150, respectively, during a power stroke of cylinder 150. Likewise, control wires 108, 106 are used again to individually control spark plugs 168, 166, respectively, during a power stroke of cylinder 160. As illustrated in FIGS. 2 and 3, individual control of eight spark plugs is provided with four control wires such that the total number of spark plug control wires is less than the total number of spark plugs. In the particular representative embodiment illustrated, the total number of spark plug control wires is equal to the number of cylinders.

FIG. 4 is a simplified schematic of one embodiment for an ignition system with individual spark plug control and ionization current sensing for an internal combustion engine having two or more spark plugs in each cylinder. In the embodiment of FIG. 4, the ignition coil has a primary winding 310 electromagnetically coupled to a center-tapped secondary winding that effectively separates the secondary winding into a first secondary winding 312 and a second secondary winding 314 with center tap conductor 316 connected to one side of primary winding 310. As in previous embodiments, secondary windings 312, 314 may be wound in opposite directions to generate voltage of the same polarity across spark plugs 86, 158 during the spark discharge. Ion sense module 302 includes opposite sense zener diodes 370, 372, a capacitor 380 and a voltage divider 384 having series connected resistors 386, 388. Controller 22 connects primary winding 310 to ground to charge the coil and electromagnetically couple secondary windings 312, 314 to primary winding 310. Controller 22 then opens the circuit to collapse the magnetic field, which generates a high voltage across secondary windings 312, 314. This high voltage is also applied across ionization sensing module 302 and spark plugs 86, 158. Zener diode 370 connected in parallel with capacitor 380 operates to charge capacitor 380 to the bias voltage, typically in the range of 80V-100V, for example. As the voltage across secondary windings 312, 314 decreases during the spark discharge to a value below the bias voltage of capacitor 380, the bias voltage of capacitor 380 is applied across secondary windings 312, 314 and across spark plugs 86, 158. The propagating flame and ions generated as the fuel/air mixture combusts within whichever cylinder is in its power stroke lowers the conducting voltage across the spark plug gaps so that a small ionization current flows through the associated spark plug 86 or 158. The ionization signal 360 produced across the voltage divider 384 and provided to controller 22 is generally attributable to only to the spark plug 86 or 158 where combustion has just occurred.

As such, the previously described embodiments have various advantages. For example, the systems and methods of the present disclosure can provide individual control of each spark plug associated with a common cylinder to more accurately control the combustion process while using only a total number of control lines corresponding to the number of cylinders to reduce cost and complexity of the control system. Individual spark plug control in a multiple spark plug per cylinder application facilitates selective simultaneous or offset firing of spark plugs associated with a common cylinder during the same phase of the combustion cycle, such as during the power stroke. Every spark plug is under programmable control of the engine controller while using only a total of one control line or wire (and controller output) per cylinder to reduce controller and driver cost as well as overall system complexity.

While the best mode has been described in detail, those familiar with the art will recognize various alternative designs and embodiments within the scope of the following claims. While various embodiments may have been described as providing advantages or being preferred over other embodiments with respect to one or more desired characteristics, as one skilled in the art is aware, one or more characteristics may be compromised to achieve desired system attributes, which depend on the specific application and implementation. These attributes include, but are not limited to: cost, strength, durability, life cycle cost, marketability, appearance, packaging, size, serviceability, weight, manufacturability, ease of assembly, etc. The embodiments discussed herein that are described as less desirable than other embodiments or prior art implementations with respect to one or more characteristics are not outside the scope of the disclosure and may be desirable for particular applications.

What is claimed is:

1. A multiple cylinder internal combustion engine comprising:

at least a first spark plug and a second spark plug associated with a first cylinder and a first spark plug and second spark plug associated with a second cylinder; and a controller coupled by a first control wire to the first spark plug of the first cylinder and the second spark plug of the second cylinder, and by a second control wire to the second spark plug of the first cylinder and the first spark plug of the second cylinder, wherein every spark plug is coupled to the controller by a control wire and the total number of spark plug control wires is less than the total number of spark plugs in the engine.

2. The engine of claim 1 wherein the total number of spark plug control wires coupled to the controller is equal to the number of cylinders in the engine.

3. The engine of claim 1 further comprising:

a first ignition coil having a first primary winding connected to the first control wire and coupled to first and second secondary windings, wherein the first secondary winding is coupled to the first spark plug of the first cylinder and the second secondary winding is coupled to the second spark plug of the second cylinder.

4. The engine of claim 3 further comprising:

a second ignition coil having a first primary winding connected to the second control wire and coupled to first and second secondary windings, wherein the first secondary winding is coupled to the second spark plug of the first cylinder and the second secondary winding is coupled to the first spark plug of the second cylinder.

5. The engine of claim 1 further comprising an ion sense circuit coupled to at least one of the spark plug control wires and selectively applying a bias voltage across at least one spark plug after spark discharge to generate an ion sensing current supplied to the controller by the spark plug control wire.

6. The engine of claim 5 wherein the ion sense circuit is connected to at least one secondary winding of an ignition coil with a primary winding connect to one of the spark plug control wires.

7. The engine of claim 1 wherein the controller applies command signals to the first and second control wires to discharge the first and second spark plugs of the first cylinder during a power stroke of the first cylinder.

8. The engine of claim 7 wherein the controller applies a first command signal to the first control wire a programmable time prior to applying a second command signal to the second control wire to provide offset firing of the first and second spark plugs of the first cylinder during the power stroke of the first cylinder.

9. The engine of claim 7 wherein the controller applies first and second command signals to respective first and second spark plug control wires at substantially the same time to provide substantially simultaneous firing of the first and second spark plugs of the first cylinder during the power stroke of the first cylinder.

10. A method for controlling an internal combustion engine having at least two spark plugs per cylinder each connected to an engine controller by a corresponding control wire with each control wire connected to at least one spark plug in each of at least two cylinders, the method comprising:

generating a first command signal on a first control wire to discharge a first spark plug of a first cylinder during a power stroke of the first cylinder and a second spark plug of a second cylinder during an exhaust stroke of the second cylinder; and generating a second command signal on a second control wire to discharge a second spark plug of the first cylinder during a power stroke of the first cylinder and a first spark plug of the second cylinder during an exhaust stroke of the second cylinder.

11. The method of claim 10 wherein the first and second command signals are generated substantially simultaneously to discharge the first and second spark plugs of the first cylinder substantially simultaneously during the power stroke of the first cylinder.

12. The method of claim 10 wherein generating a second command signal on the second control wire is performed a programmable interval after generating a first command signal on the first control wire.

13. The method of claim 12 wherein the programmable interval is based on an ion sense current feedback signal.

14. The method of claim 10 wherein generating a first command signal on a first control wire discharges the first spark plug of the first cylinder during a power stroke of the first cylinder while substantially simultaneously discharging a second spark plug of a second cylinder during other than a power stroke of the second cylinder.

15. The method of claim 10 further comprising:

applying a bias voltage across at least one of the first and second spark plugs of the first cylinder after generating the first and second command signals to generate an ion sense current on at least one of the first and second control wires.

16. The method of claim 10 wherein generating the first command signal comprises applying a first command signal to a primary winding of a first ignition coil having a first secondary winding connected to the first spark plug of the first cylinder and a second secondary winding connected to a second spark plug of a second cylinder.

17. A method for controlling an engine having at least two spark plugs per cylinder comprising:

discharging first and second spark plugs of a first cylinder substantially simultaneously during a power stroke of the first cylinder; and a second spark plug during an exhaust stroke of a second cylinder; and discharging first and second spark plugs of a second cylinder a programmable interval after the spark plugs of the first cylinder during an exhaust stroke.

18. The method of claim 17 further comprising:

applying a bias voltage across at least one of the first and second spark plugs of the first cylinder to generate an ion sense current on at least one of the first and second control wires.

19. The method of claim 18 wherein the programmable interval is based on an ion sense current feedback signal.

20. The method of claim 17 further comprising generating a first command signal to discharge the first spark plug by applying the first command signal to a primary winding of a first ignition coil having a first secondary winding connected to the first spark plug of the first cylinder and a second secondary winding connected to a second spark plug of a second cylinder.

* * * * *